US007772471B2

(12) United States Patent
Bustamante

(10) Patent No.: US 7,772,471 B2
(45) Date of Patent: Aug. 10, 2010

(54) GUITAR SUPPORT

(76) Inventor: James M. Bustamante, 1750 N. Gulley, Dearborn, MI (US) 48128

( * ) Notice: Subject to any disclaimer, the term of this patent is extended or adjusted under 35 U.S.C. 154(b) by 0 days.

(21) Appl. No.: 12/481,129

(22) Filed: Jun. 9, 2009

(65) Prior Publication Data

US 2009/0308222 A1 Dec. 17, 2009

Related U.S. Application Data

(60) Provisional application No. 61/060,498, filed on Jun. 11, 2008.

(51) Int. Cl.
*G10D 3/00* (2006.01)

(52) U.S. Cl. ..... 84/327

(58) Field of Classification Search ..... 84/327, 84/379, 453

See application file for complete search history.

(56) References Cited

U.S. PATENT DOCUMENTS

| | | | | |
|---|---|---|---|---|
| 4,223,785 | A | 9/1980 | Jacques | |
| 4,474,290 | A | 10/1984 | DeMato | |
| 5,346,073 | A | 9/1994 | Broersma et al. | |
| 5,833,051 | A | 11/1998 | Tiefenbrun et al. | |
| 6,462,260 | B2 | 10/2002 | Fediakov | |
| 6,670,536 | B2 | 12/2003 | Godin et al. | |
| 6,835,883 | B2 | 12/2004 | Stevens | |
| 2006/0032359 | A1 | 2/2006 | Smith | |
| 2007/0204742 | A1 * | 9/2007 | Wilkerson | 84/329 |

FOREIGN PATENT DOCUMENTS

| | | | |
|---|---|---|---|
| JP | 2004344406 | A | 12/2004 |
| JP | 2006220945 | A | 8/2006 |
| KR | 1020030067629 | A | 8/2003 |

OTHER PUBLICATIONS

International Search Report.

* cited by examiner

*Primary Examiner*—Kimberly R Lockett
(74) *Attorney, Agent, or Firm*—Gifford, Krass, Sprinkle, Anderson & Citkowski, P.C.

(57) ABSTRACT

In order to allow a two-sided instrument case to also serve as a stand for guitars and the like, when the case is in its open position, a flat plate having a central notch in one end is adapted to be supported between the open case side so it is closely spaced relative to the hinge which joins the case sides. When the case is moved to the closed position, the plate may either be removed for storage in the case with the instrument, or may be alternatively positioned so that it may be folded into a closed position within the case.

11 Claims, 8 Drawing Sheets

GUITAR SUPPORT

CROSS-REFERENCE TO RELATED APPLICATIONS

This application claims priority of U.S. Provisional Patent Application Ser. No. 61/060,498 filed Jun. 11, 2008, which is incorporated herein by reference.

FIELD OF THE INVENTION

This invention relates to guitar cases which can also serve as stands for supporting guitars in a vertical position and to attachments for conventional guitar cases for converting them into the dual capability form.

BACKGROUND OF THE INVENTION

Guitars are usually transported in appropriately sized instrument cases. Often, during a performance, a guitar player has the need to set down a guitar and special stands are provided for this purpose. However, having to transport a guitar stand in addition to the guitar case can be cumbersome. Also, a guitar stand requires additional space to set up and utilize. In many instances this is inconvenient if the space is limited such as on a small stage. Accordingly, U.S. Publication No. 2006/0032359 discloses a case for guitars incorporating an elongated bar or plate which is adapted to be supported on the top of the case when it is partly open. The bar has a recess therein shaped to receive the neck of a guitar or like musical instrument.

This method of converting a guitar case into a stand suffers from a number of defects. First, the bar is only retained on the top edges of the open case by the force of gravity and may easily be dislodged. The bar can be easily moved out of its intended position when a guitar is inserted or removed from the stand, creating the potential for the guitar to fall. Additionally, the bar needs to be carried separately from the case and the bar could be easily mislaid.

SUMMARY OF THE INVENTION

The present invention is accordingly directed toward a guitar case having means for supporting a guitar in a vertical attitude when the case is opened and supported on a horizontal surface. The present invention is also directed toward an attachment which can convert conventional guitar cases into combination case-stands as well as to cases in which the attachment is integrated with the case and may be moved into an operating position when the case is open.

One preferred embodiment of the invention, which will subsequently be described in detail, comprises a plate having a notch formed on one of its sides of a size and shape adapted to engage the guitar just below the headstock, where the headstock is wider in dimension than the uppermost portion of the neck. This plate may easily be carried in a closed guitar case, with the instrument, and may be secured to the open case, without the use of any special tools, by means of a unique arrangement involving rubber bushings which may be connected to holes in the plate and the case to secure them together. Alternatively, the bushings may be fixed within the top of the case so as to project above the top and be manually insertable, without the use of tools, in a secure manner within holes in the plate.

Another embodiment of the invention which will be subsequently disclosed in detail involves a plate which is mounted within the guitar case so as to extend below the top of an opened case and includes the notched plate with a resilient covering. When the guitar case is closed, a cam arrangement working between the two sides of the case swings the plate into one of the case sides so that the case may close about a guitar and retain the plate in a secure position.

Still another embodiment of the invention, which will be subsequently disclosed in detail, involves a different support arrangement for a notched plate with a resilient cover that may be retained within the closed case and automatically swings into operative position when the case is opened. The plate is supported at its opposed ends by pivotable connections formed to project out of the two case sides.

In still another embodiment of the invention, the notched support plate is supported totally on the interior case of one of the case halves and when the cases are open it may be manually pivoted into an operative position to secure a guitar neck.

In all of the embodiments, when the support plate is in its operative position, with the notch facing outwardly from the open case, the bottom edge of the notch is within four inches of the hinge line of the case.

BRIEF DESCRIPTION OF THE DRAWINGS

Other objects, advantages and applications of the present invention will be made apparent by die following detailed description of the embodiments of the invention. The description makes reference to the accompanying drawings in which.

DETAILED DESCRIPTION OF A PREFERRED EMBODIMENT

Figure 1:
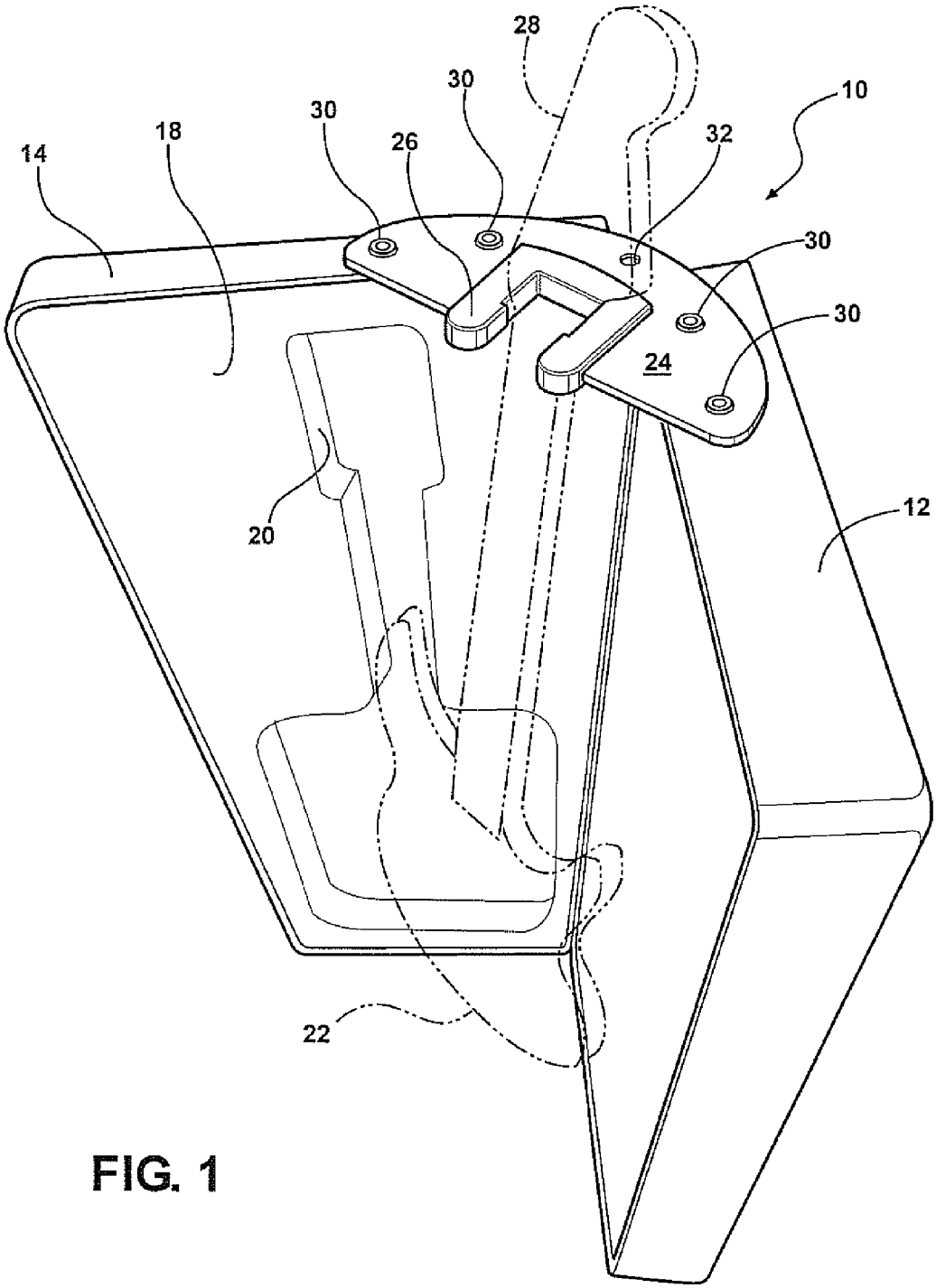
FIG. 1 is a perspective illustration from the top of a guitar case equipped with a first embodiment of the invention taking the form of a support plate that may be easily secured to the two sides of an open case to support a guitar, illustrated in phantom lines, or may be removed to allow the case to be closed.

Referring to the drawings, a typical guitar case, disposed in an open position, is generally indicated at 10 in FIG. 1. The case consists of a pair of sections 12 and 14 which are rectangular in shape and are joined at one of their long edges by a hinge 16 which may be best seen in FIGS. 6 and 7. The two sides 12 and 14 are dish shaped, with edges. One or both of the sides 12 and 14 may include foam sections such as 18 which may be shaped to support a guitar as at 20.

While the term "guitar" is used throughout the specification, it should be understood that other similar instruments such as violins, banjos or the like could utilize cases/stands of the type disclosed in the present invention and the term "guitar" should be considered as a species of this more generic instrument.

A guitar, illustrated in phantom at 22, is adapted to fit within the foam cushioning section 20 so that the case may be closed about the guitar for carrying purposes.

In its open position, as illustrated in FIG. 1, the case sides 12 and 14 may be disposed at substantially 90 degrees to one another so that the case, when disposed on a horizontal surface, is substantially self-supporting in an upright manner. In that position, an attachment, taking the form of a plate 24, may be secured to the upper edges of the sides 12 and 14 adjacent to the hinge 16. The plate 24 has an open-ended notch preferably covered by a resilient pad 26, which may be formed of an elastomer. The notch is adapted to support the guitar 22 by surrounding it about its neck adjacent to the wider headstock 28 so that the guitar may hang down between the sides of the case with the edges of the guitar preferably abutting the two case sides.

The preferred embodiment of the plate 24 has four holes 30 formed at spaced points about its surface. Additionally, it has a center hole 32. The center hole may be used to align the plate 24 with respect to the top surfaces of the case so that holes may be drilled in the case to accommodate bushings 34 which are used to connect the plate to the case.

Figure 2:
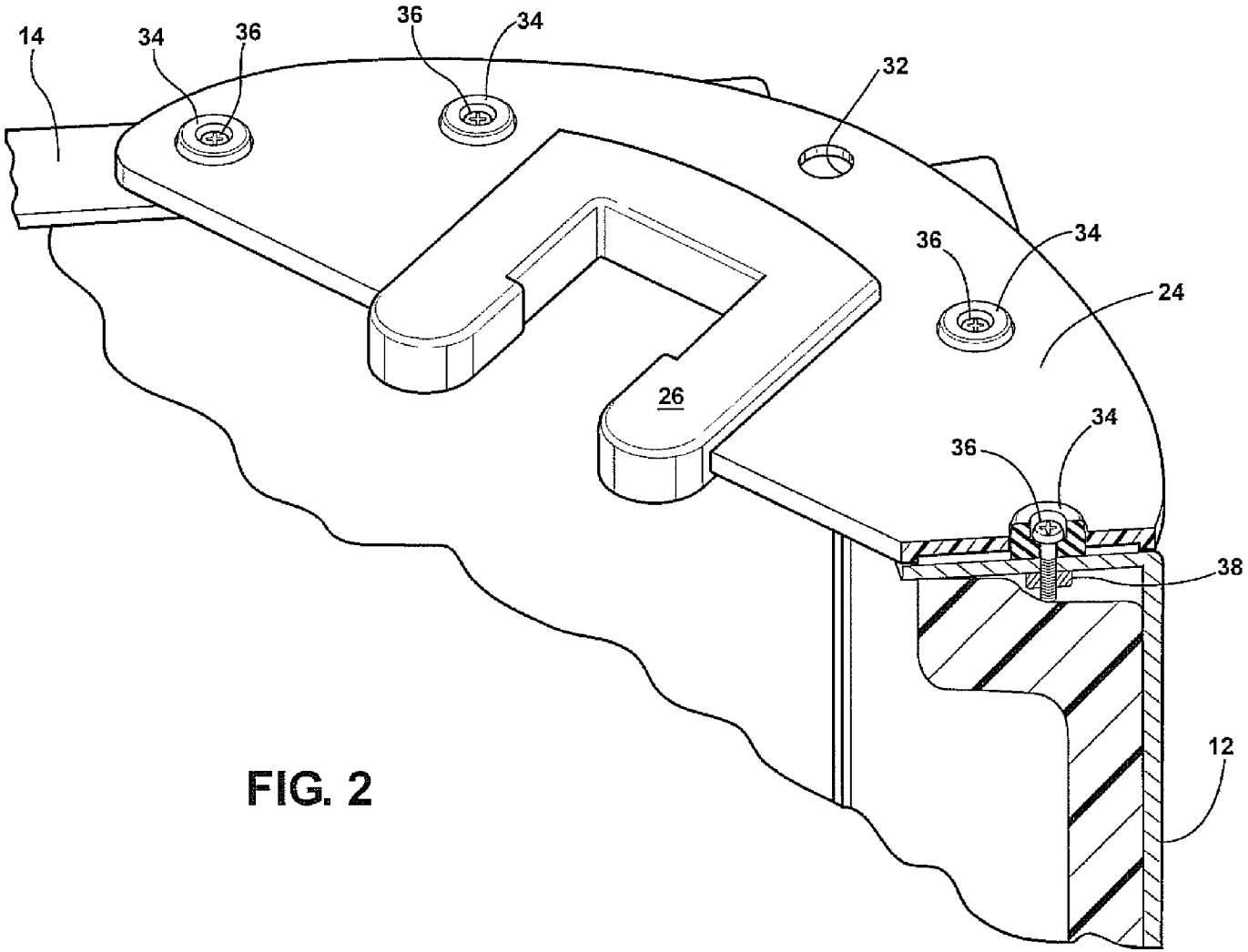
FIG. 2 is a top perspective detailed view, partially broken away, of the embodiment illustrated in FIG. 1 showing the method of retaining the rubber bushings which project above the top of the case and allow the support plate to be readily joined to and removed from the case.

As illustrated in the broken-away section of FIG. 2, holes may be formed in the top of the case to accommodate screws 36 which retain the circular bushings with center holes 34 onto the top of the case. The screws 36 are secured by nuts 38 disposed on the underside of the case. The bushings 34 compressively engage the holes 30 in the plate 34. This allows the plate to be pressed into engagement with the bushings, where it is securely retained, and allows the plate to easily be removed from the bushings without the use of any tools.

The holes 30 in the plate 24 are arranged such that when the hole 32 is aligned over the hinge 16, the major axis of the plate 24, illustrated by the dotted line 40, and similar axes between the hole 32 and the two adjacent holes 30 form a substantially right-angle triangle.

Figure 3:
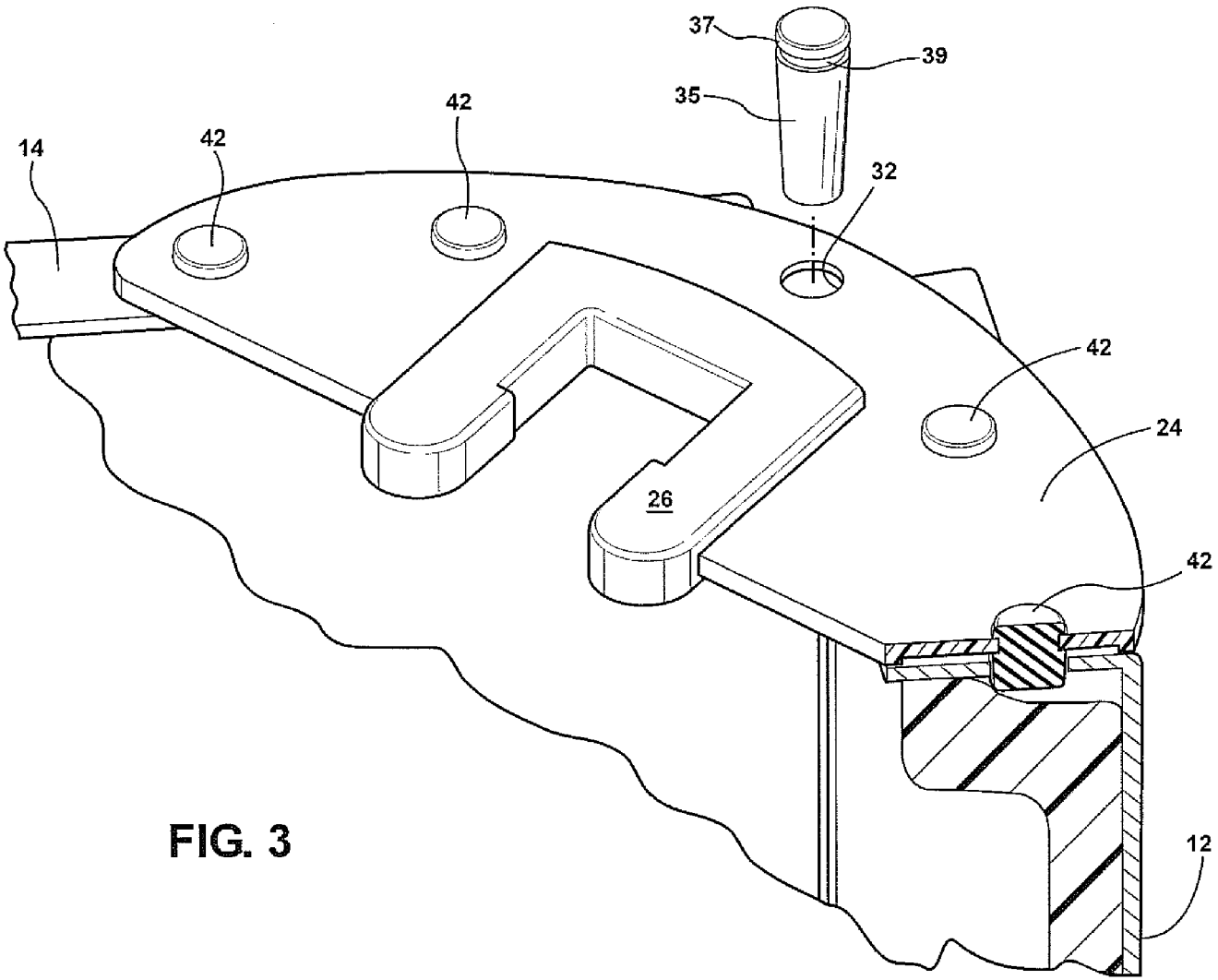
FIG. 3 is a top perspective view of a variation on the first embodiment of the invention wherein the rubber support bushings which allow the support plate to be easily attached to and removed from the case are retained in both the case and the plate by means of resilient engagement of the bushings with holes in those structures.

FIG. 3 illustrates an alternative form of bushing 42 which may be used to secure the plate 24 to the case 10, without the need for permanently affixing the bushings in the top surface of the case, as is illustrated in FIG. 2. As is illustrated in FIG. 3, larger holes, the same size as the holes 30, are formed in the top of the case in alignment with the holes 30 in the plate. Bushings 42 which compressively engage both the holes in the plate and the holes in the case are then used to removably attach the plate 24 to the top of the case.

As shown in FIG. 3, the holes for the bushings 4 are located through use of a cylinder 35, formed of an elastomer, having a head 37 at one end, separated from the body of cylinder 35 by a cylindrical notch 39. The body of cylinder 35 is squeezed through the center hole 32 so that the notch 39 is captured by the edges of the case 10 and the head 37 is on top of the plate 24. The cylinder extends into the angle between the two open case sides, at the hinge, so that the holes 30 overlie the top of the case 10 and may be used as guides to form the complementary holes in the case top.

When either of the arrangements for fastening the support plate 24 to the case 10 is employed, in addition to properly supporting the plate, the case sides are rigidly locked at the proper angle. The inner side of the notch 26 is positioned within four inches of the hole 32 so that the structure resists accidental misalignment.

Figure 6:
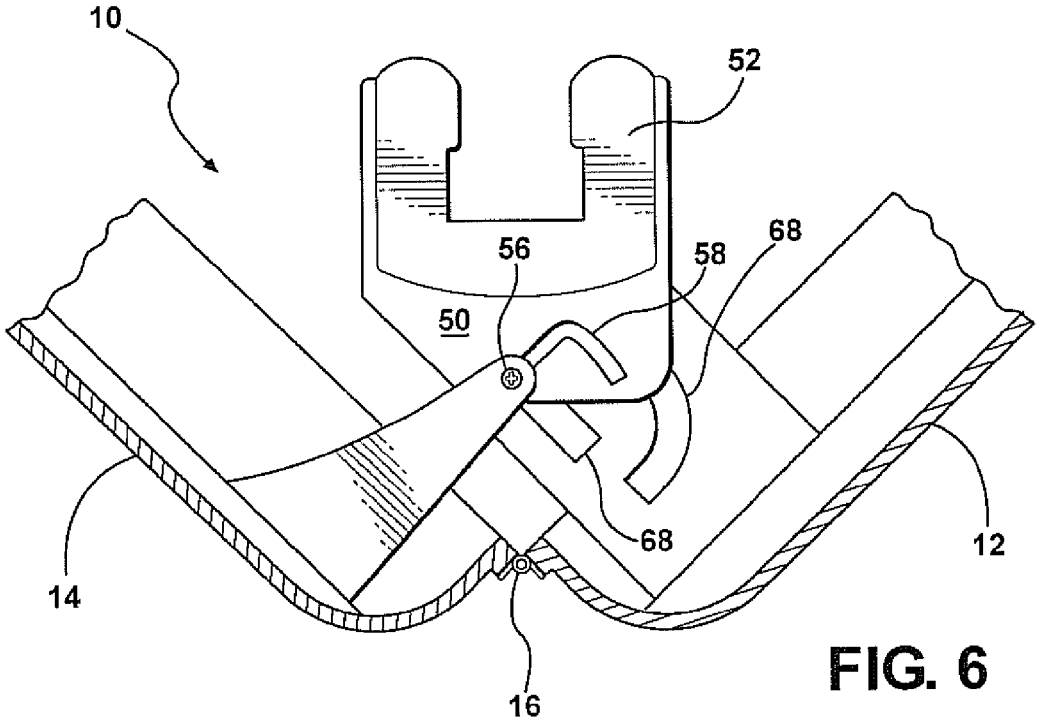
FIG. 6 is a top view of the embodiments of FIGS. 4 and 5 showing the case opened and the attachment plate in its operative position.
Figure 7:
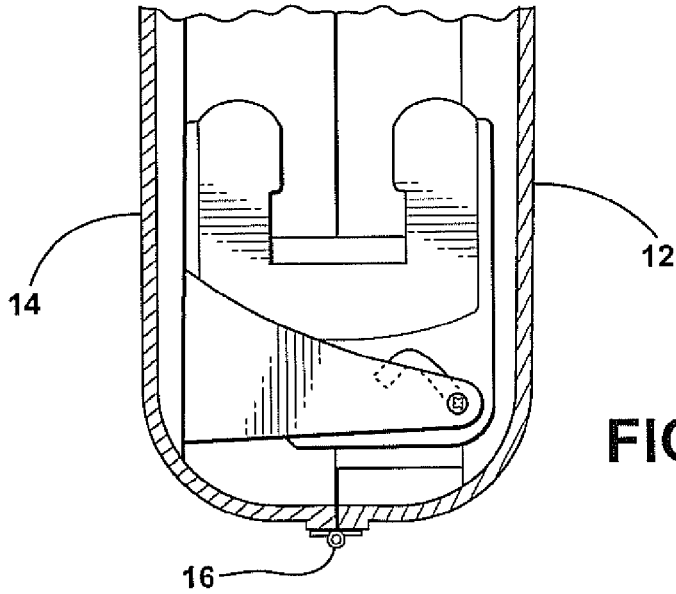
FIG. 7 is a top view, partially broken away, showing the position of the embodiments of FIGS. 4, 5 and 6 when the case is closed.

FIGS. 4, 5, 6 and 7 illustrate an alternative embodiment of the invention wherein a smaller support plate 50 than the plate 24 having a resilient cushion 52 formed about a three-sided notch formed in the forward end of the plate 50 may be automatically moved from a retracted position within the closed case, as shown in FIG. 7, or an operative, extended position as illustrated in FIG. 6, when the case 10 is opened.

The mechanism for moving the plate 50 between its retracted and extended positions comprises a cam arm 54 having one end connected to the interior of the case side 12 and projecting over the top of the plate 50, and a cam plate 56 having one straight groove 68 and one curved groove 60. A plate 62, disposed on the lower side of the plate 56, carries a pair of elongated cam followers, one of which, 64, extends into the groove 60 and the other of which, 66, extends into the groove 68.

Figure 4:
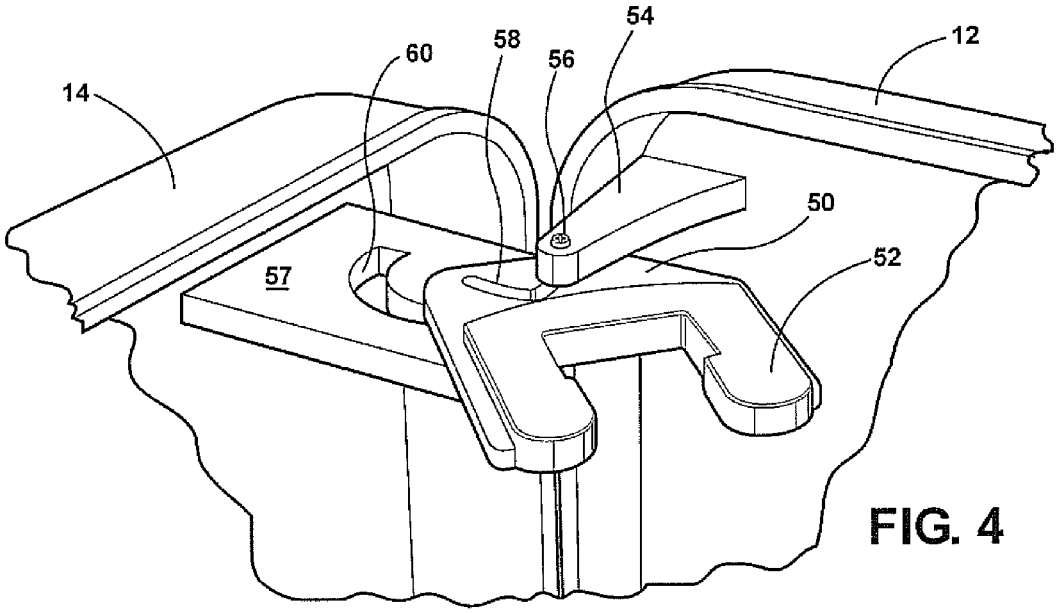
FIG. 4 is a top perspective view of an opened guitar case at one end, showing an alternative embodiment of the invention in which the guitar retainer plate is permanently installed in the case and swings between an operative position when the case is opened and a position within the case when the case is closed.
Figure 5:
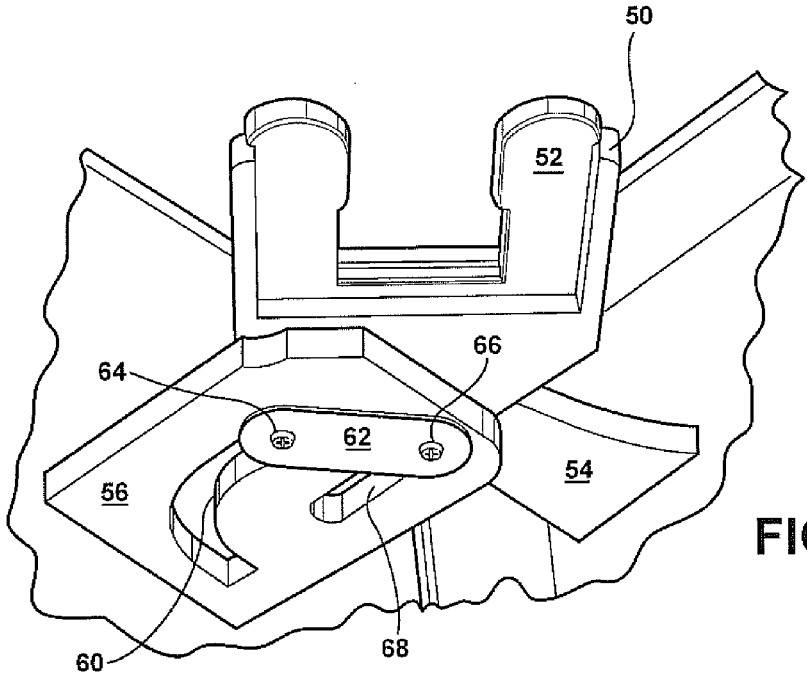
FIG. 5 is a bottom perspective view of the embodiment of the guitar stand illustrated in FIG. 4.

As the sides 12 and 14 of the case 10 are moved from the open position, illustrated in FIGS. 4 and 6, to the closed position, illustrated in FIG. 7, the motion of the cam follower 56 forces the plate 50 first to move toward its retracted position. It receives its final push into the retracted position by contact between the side of the plate 50 and the side of the case 12.

In its retracted position as illustrated in FIG. 7 it does not project into the space occupied by a guitar or other instrument supported in the case. In its extended position, as shown in FIGS. 4 and 6, the same equilateral triangle position noted by the dotted line 40 in FIG. 2 exists.

Figure 8:
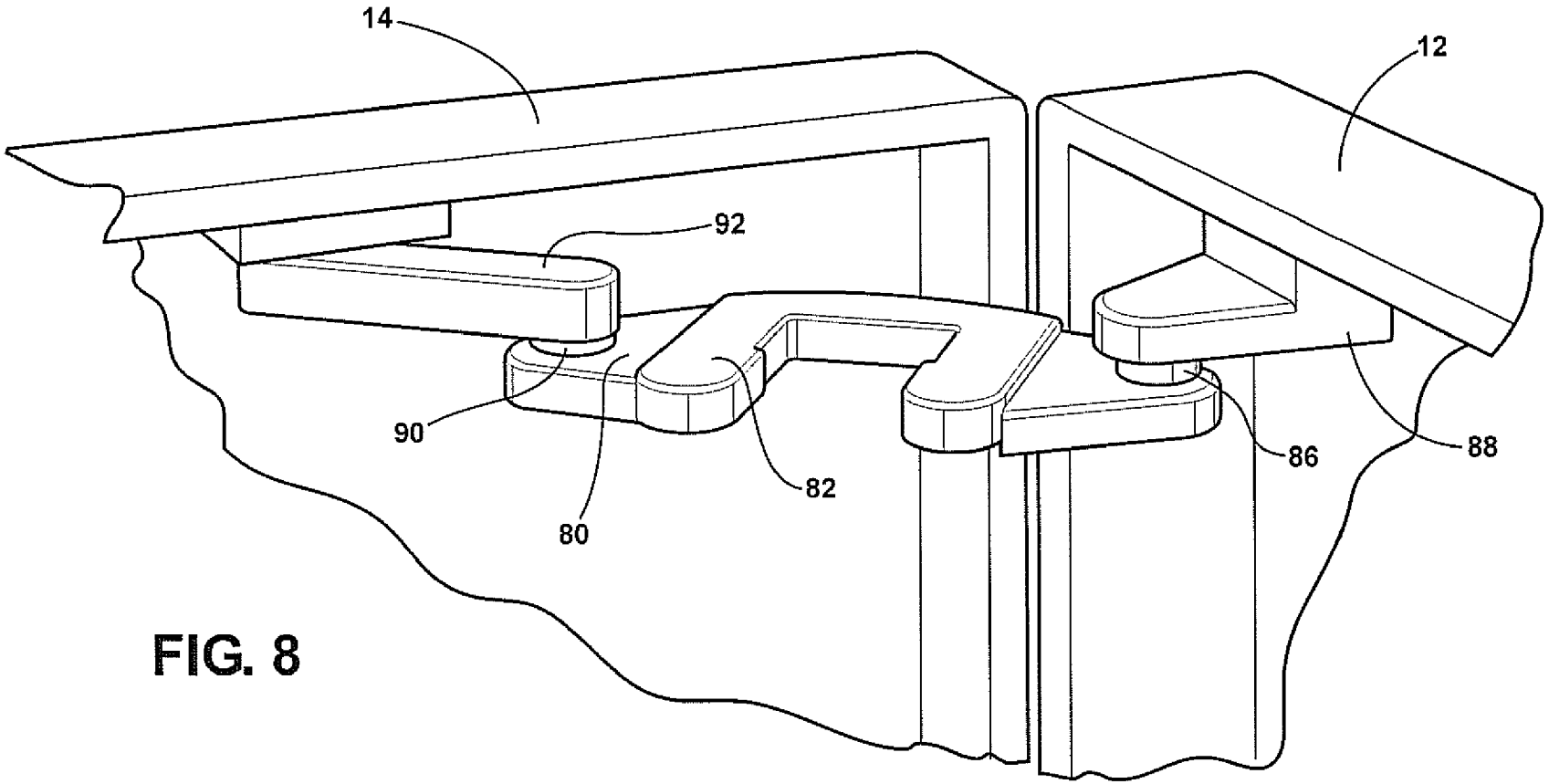
FIG. 8 is a top perspective view of another embodiment of the invention which moves between a retracted position within the case when the case is closed and an operative position when the case is open, under forces induced by opening and closing the case.
Figure 9:
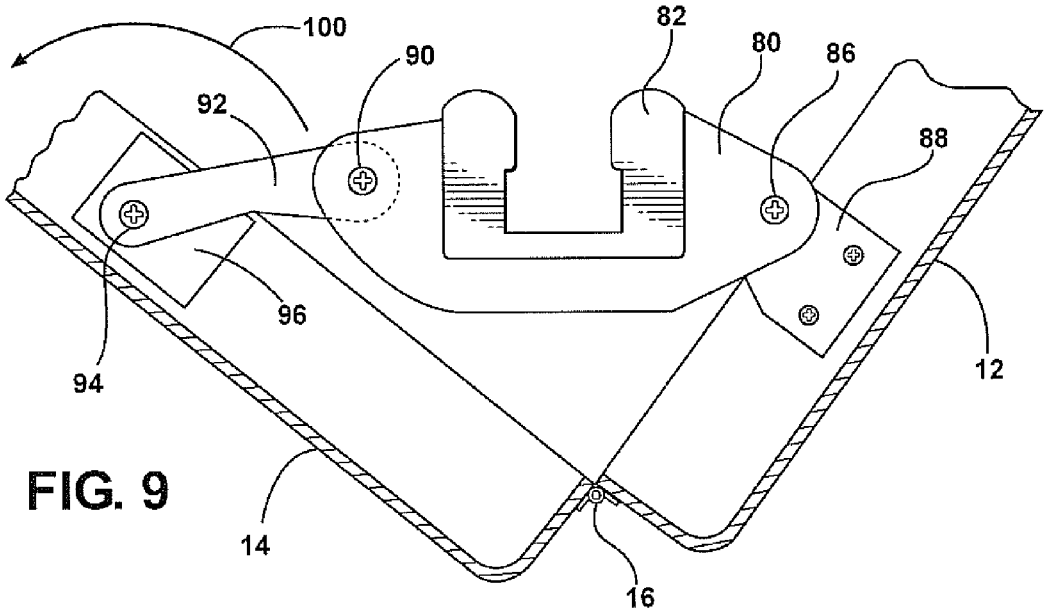
FIG. 9 is a bottom view of the embodiment of FIG. 8 shown with the case opened and the retaining plate in an operative position.
Figure 10:
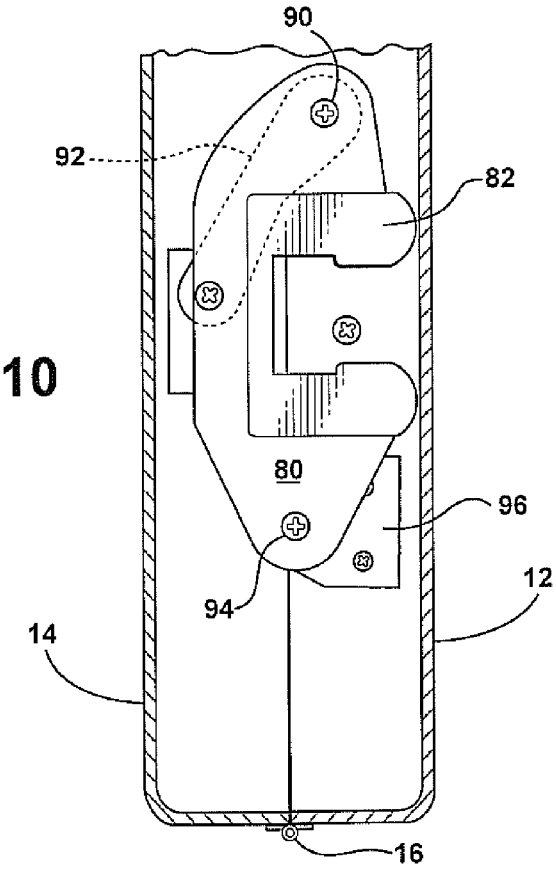
FIG. 10 is a top view, partially broken away, illustrating the embodiment of FIGS. 8 and 9 in a retracted position when the cases are closed.

FIGS. 8, 9 and 10 illustrate another embodiment of the invention in which a notched guitar support plate 80, having a resilient bumper 82 surrounding the notch, is pivotably supported between the two case sides 12 and 14 so that when the case sides are opened, as illustrated in FIGS. 8 and 9, the plate 80 is in operative position to support a guitar; and when the case sides are closed, as illustrated in FIG. 10, the plate 80 and its supporting mechanism are neatly folded within the case, adjacent the top, so as to avoid interference with the guitar which is also supported in the case.

One end of the plate 80 is pivotably supported about a vertically extending pivot point 86. The pivot point 86 is supported at the outward end of a support arm 88 which projects from the case side 12.

The other end of the support plate 80 is pivotably supported about a second pivot point 90 which is retained in a vertical manner, parallel to the side of the case 14, at one end of a pivotable link arm 92. The other end of the link arm 92 is pivotably supported within the top side edge of the case section 14 by a pivot point 94. A support block 96 secured to the top side of the case supports the pivot point 94.

When the case is opened, as illustrated in FIG. 9, one end of the plate 80 rotates about the pivot point 86 and the other rotates about the pivot point 90. This pulls the link arm 92 into the position shown in FIG. 9.

When the case is closed, as illustrated in FIG. 10, the link arm pivots in the direction of the arrow 100 shown in FIG. 9 into the closed position illustrated in FIG. 10 and the forward edges of the bumper 82 bear against the interior of the case side 12, as illustrated in FIG. 10.

Figure 11:
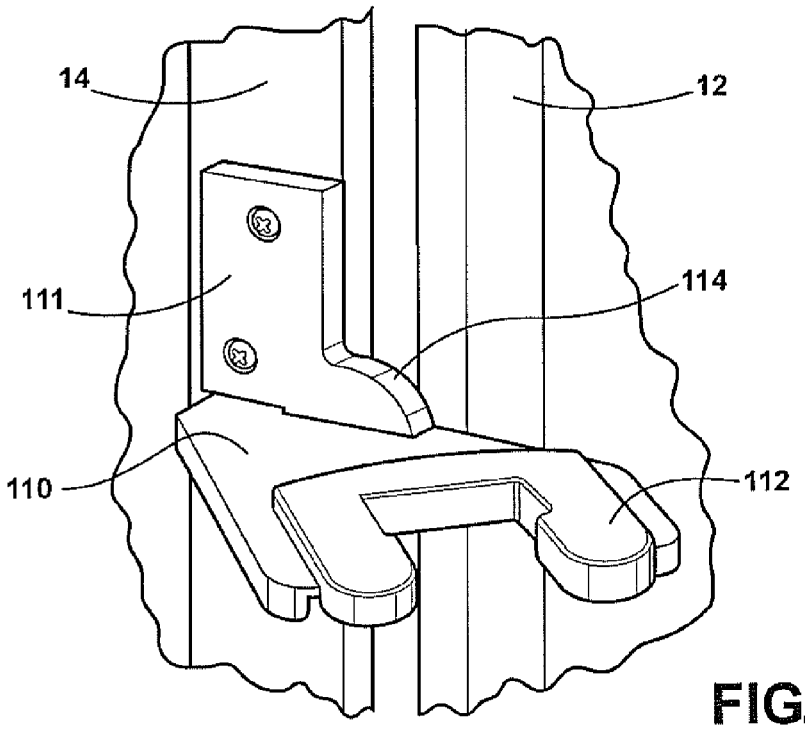
FIG. 11 is a top perspective view of another embodiment of my invention supported in an open case in an operative position.
Figure 12:
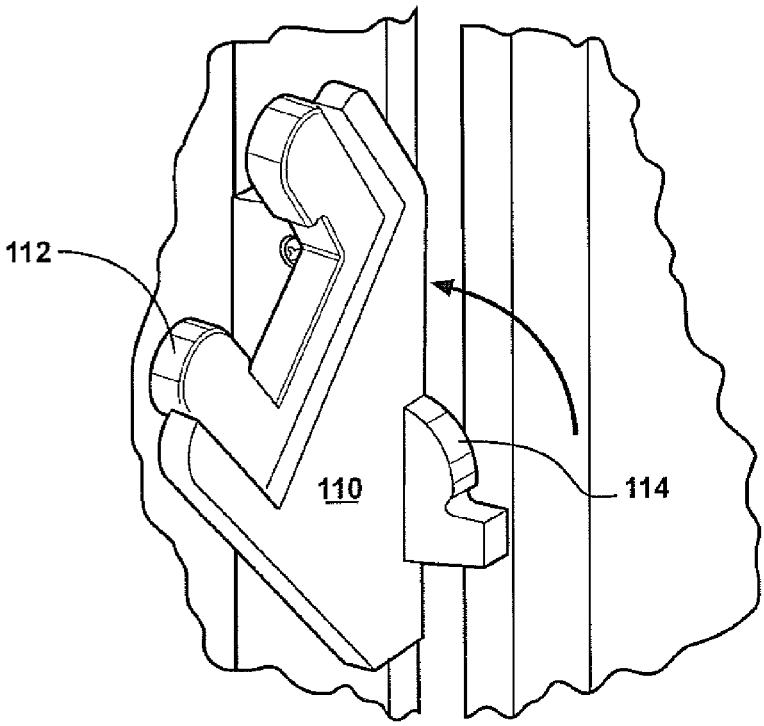
FIG. 12 is a perspective view of the embodiment of FIG. 11 folded into a retracted position to allow closure of the case.

FIGS. 11 and 12 illustrate still another embodiment of the invention, wherein a notched support plate 110 having a resilient bumper 112 retained about the notch is rotatably supported with respect to the edge of the case side 14 so that it when the case is opened, it may be manually moved between the position shown in FIG. 11, wherein the plate extends outwardly in an operative position, normally to the case sides, or a closed position, illustrated in FIG. 12, wherein the plate 10 extends parallel to the case sides. This motion is guided about a cam plate 111 fixed to the interior of one of the case sides, which has an arcuate surface 114 which guides the plate 110 between its open and closed positions.

Having thus disclosed my invention, I claim:

1. An attachment for a guitar case of the type having a pair of rectangular sides each having a major dimension and a minor dimension at right angles to the major dimension, the sides being joined at edges extending in the major dimension of each side by a hinged joint to allow the sides to move between a closed position in which the sides are parallel to and abut one another and an open position in which the sides are arranged at approximately 90 degrees to one another, so that the case is self-supporting when one end of each side is supported on a horizontal surface, the attachment comprising:

a support plate having an open faced notch with parallel sides, the plate being adapted to be supported between the two sides of the case at points adjacent the hinge line, at one end of the case, so that when the case is open with its sides extending at approximately 90 degrees to one another, with the notch facing away from the hinges, the distance from the hinges to the bottom of the notch is less than four inches; and a resilient cover for the parallel two sides of the notch adapted to receive the neck of a guitar sized to be enclosed in the case;

whereby, when the case is in an open position, supported on a horizontal surface so that the hinged joint is disposed vertically, the notch in the retainer is operative to support the guitar by the neck so that it hangs downwardly between the opposed sides of the case.

2. The attachment for a guitar case of claim 1 wherein the support plate is adapted to be connected to the guitar case when the case is in an open position and to be disconnected from the guitar case to allow it to move to a closed position.

3. The attachment for a guitar case of claim 2 wherein the support plate is connected to the case when the case is open with its sides extending approximately 90 degrees to one another, by resilient bushings adapted to be secured at spaced points to the plate and pass through spaced holes formed in the case, parallel to the major dimension of the case.

4. The attachment for a guitar case of claim 3 wherein the resilient bushings are retained in the holes in the case by threaded fasteners.

5. The attachment for a guitar case of claim 4 wherein the support plate has a hole formed in its center which may be used to align the plate with the hinges of the case.

6. The attachment for a guitar case of claim 1 in which the support plate is pivotably connected to two support plates, one of which is connected to each side of the interior of the case, so that motion of the case moving between an open and closed position moves the plate from a position in which it is in an operative position, with the notch extending away from the interior of the case, to a retracted position in which it is retained within the closed case.

7. The attachment for a guitar case of claim 6 in which the support plate has one end pivotably connected to the outwardly projecting end of an arm fixed to one side of the case and the other end of the plate is pivotably supported to the end of a link which is itself pivotably supported on the other side of the case; whereby the motion of the case moving between an open and a closed position moves the plate from a position in which the open end of the notch projects away from the hinges into a position rotated 90 degrees relative to such open position, wherein the case is closed with the rigid plate being supported within the case.

8. The attachment for a guitar case of claim 6 in which a cam track is formed within the support plate and a cam follower supported on an arm extending from one of the interior sides of the case moves along the cam track as the case is moved between open and closed positions.

9. The attachment for a guitar case of claim 8, further including a second cam track, formed on a plate extending from the interior plate having one end fixed to the interior of the other case side and a cam mechanism extending between the track and the second plate and support plate, so as to move the support plate between its extended position when the case is opened and a retracted position, within the case, when the case is closed.

10. The attachment for a guitar case of claim 1 in which the support plate is pivotably supported on a member secured to the interior of one of the case sides, so that the support plate may be manually repositioned between a first position in which a support plate is parallel to its supporting case side and the case may be closed, and an open position, wherein the support plate extends in an operative position, normally to the two case sides.

11. An attachment for a guitar case of the type having a pair of rectangular sides joined at edges by a hinge to allow the sides to move between a closed position in which the sides are parallel to and abut one another and an open position in which the sides are arranged approximately 90 degrees to one another, so that the case is self-supporting when one end of each side is supported on a horizontal surface, the attachment comprising a support plate having an open-faced notch with parallel sides, the support plate being supported within the sides with securement to at least one of the sides of the case, and being movable between an operative position wherein the notch faces outwardly from the case sides and a closed position wherein the support plate may be retained within the closed case.

* * * * *